US010648785B1

(12) United States Patent
Lucas et al.

(10) Patent No.: US 10,648,785 B1
(45) Date of Patent: May 12, 2020

(54) MUNITION WITH CONTROLLED SELF NEUTRALIZATION

(71) Applicant: Northrop Grumman Innovation Systems, Inc., Plymouth, MN (US)

(72) Inventors: James D. Lucas, Chanhassen, MN (US); William E. Warp, Crystal, MN (US); Nathan W. Miller, Plymouth, MN (US); Kenneth Fink, Elk River, MN (US); Thomas Lorentz, Princeton, MN (US)

(73) Assignee: Northrop Grumman Innovation Systems, Inc., Plymouth, MN (US)

( * ) Notice: Subject to any disclaimer, the term of this patent is extended or adjusted under 35 U.S.C. 154(b) by 11 days.

(21) Appl. No.: 16/350,299

(22) Filed: Oct. 29, 2018

Related U.S. Application Data

(60) Provisional application No. 62/579,006, filed on Oct. 30, 2017.

(51) Int. Cl.
*F42D 5/04* (2006.01)
*F42B 3/12* (2006.01)

(52) U.S. Cl.
CPC ..... *F42D 5/04* (2013.01); *F42B 3/124* (2013.01)

(58) Field of Classification Search
CPC .. F42D 5/04; F42B 3/124; F42C 15/40; F42C 15/42; F42C 15/44
USPC ..... 102/221
See application file for complete search history.

(56) References Cited

U.S. PATENT DOCUMENTS 5,431,104 A * 7/1995 Barker ..... F42B 3/124 102/202.7
5,489,909 A 2/1996 Dittmann et al.
6,308,607 B1 * 10/2001 Woodall ..... B64D 1/04 102/402
7,305,467 B2 12/2007 Kaiser et al.
7,331,268 B1 * 2/2008 Pangilinan ..... F42B 33/06 102/305
7,987,787 B1 * 8/2011 Sudick ..... F42B 3/18 102/202.1
8,371,224 B1 * 2/2013 Boswell ..... F42C 19/0807 102/217
8,812,654 B2 8/2014 Gelvin et al.
8,832,244 B2 9/2014 Gelvin et al.
(Continued)

*Primary Examiner* — Joshua E Freeman
(74) *Attorney, Agent, or Firm* — Christensen, Fonder, Dardi & Herbert PLLC

(57) ABSTRACT

Methods, systems, and devices for an area-denial munition configured for self-neutralization of an explosive ordnance. In one or more embodiments the munition including a housing including a chassis defining one or more openings such that the housing is an at least partially open structure exposing an interior to an ambient environment. In various embodiments the munition includes a detonation module including a detonation initiator and a deflagration module including a deflagration initiator coupled with a pyrotechnic primer, and munition control circuitry. In various embodiments the munition control circuitry receives instructions to deflagrate the explosive ordnance and instructs the deflagration module to activate the deflagration initiator. In various embodiments, the deflagration initiator causes a deflagration of the explosive ordnance for self-neutralization of the munition resulting in safe destruction of the munition's explosive charge and control electronics.

20 Claims, 7 Drawing Sheets

(56) References Cited

U.S. PATENT DOCUMENTS

| | | | | |
|---|---|---|---|---|
| 8,836,503 | B2 | 9/2014 | Gelvin et al. | |
| 8,931,415 | B2 * | 1/2015 | Volkmann | F42B 3/16 102/217 |
| 9,273,939 | B2 * | 3/2016 | Ackermann | F42C 15/00 |
| 9,766,048 | B2 * | 9/2017 | Graswald | F42B 3/22 |
| 10,228,226 | B2 * | 3/2019 | Florian | F42C 19/0842 |
| 2012/0192704 | A1 * | 8/2012 | Wilson | F42B 12/46 86/50 |
| 2012/0227609 | A1 * | 9/2012 | Volkmann | F42B 3/16 102/322 |

* cited by examiner

MUNITION WITH CONTROLLED SELF NEUTRALIZATION

CROSS REFERENCE TO RELATED APPLICATIONS

This application claims the benefit of U.S. Provisional Application No. 62/579,006, filed Oct. 30, 2017, the entire contents of which are incorporated by reference herein.

TECHNICAL FIELD

The present disclosure relates to area denial munitions, and more specifically, to area-denial munitions configured for controlled self-neutralization.

BACKGROUND

Area denial systems generally include a plurality of lethal or non-lethal munitions that can be deployed as a defensive system to deny access to terrain, to focus or direct enemy movement, reduce enemy morale, or to accomplish other various tactical objectives. In addition, certain area denial systems can be deeply deployed into enemy territory, quickly placed in front of moving formations of enemy units, or quickly deployed for other purposes via artillery scatterable and aircraft scatterable munitions.

Area denial munitions generally include some form of explosive material or ordnance that can be initiated by detonation devices. Explosive materials contained in an explosive device may be ignited in several different ways. For example, explosive materials have been ignited by flame ignition (e.g., fuzes or ignition of a priming explosive), impact (which often ignites a priming explosive), chemical interaction (e.g., contact with a reactive or activating fluid), or electrical ignition. Electrical ignition may occur in at least two distinct ways, as by ignition of a priming material (e.g., electrically ignited blasting cap or priming material) or by direct energizing of an explosive mass by electrical power. These various ignition systems enable explosive devices such as explosive projectiles to detonate at a desired time. Depending on the application, this desired time may be before impact, at a specific point during flight, during impact, or at some time delay after impact.

While detonation of the explosive material in a munition may be desirable in some instances, such as to accomplish area-denial objectives, detonation of the explosive material may also be undesirable in other applications. For example, detonation of the explosive material may be undesirable when unintended targets are present, or subsequent to combat operations, when the munition may still be deployed but area-denial objectives are no longer required.

Known munition systems, such as the M-7 Spider and the XM1100 Scorpion, include a plurality of networked munitions, sensors, and communication devices. Once these systems are deployed, a human operator at a remotely located control station can choose to fire one or more of the munitions, for example in response to feedback from the sensors that indicates the presence of an enemy target. Networking elements for remote control of sensors and other devices, such as munitions, is well known in the art. See for example, U.S. Pat. Nos. 8,832,244; 8,836,503; 8,812,654; 7,305,467; and 5,489,909, each incorporated herein by reference for all purposes.

Modern area denial systems which utilize anti-personnel munitions are generally configured for "human in the loop" operation of the anti-personnel munitions, requiring human authorization of fire commands for the munitions in the system. In addition, known area denial systems which utilize anti-vehicle munitions generally include human in the loop operated anti-personnel munitions to make removal of the anti-vehicle munitions more difficult.

Proper execution of an area denial system can be difficult, requiring proper set up and consideration of various technical issues that are necessitated by long range remote control of the networked sensors and munitions. In addition, area denial systems generally require some form of removal or neutralization after combat operations are over. As such, an area denial munition that improves or resolves those technical issues, and/or improves the efficiency of area denial systems would be well received.

SUMMARY

Various embodiments of the disclosure are directed to an area-denial munition configured for controlled self-neutralization. In various embodiments, the munition includes a housing, an explosive ordnance, a detonation module, a deflagration module, and various electronic circuitry for munition operation/control. In various embodiments the housing is an open or non-enclosed structure defined by a chassis including one or more openings exposing the interior of the housing to the ambient environment.

In addition, one or more embodiments of the disclosure provide benefits from providing an area-denial munition or ordnance capable of self-neutralization of a deployed and unexploded ordnance left on a battlefield after a military mission has ended. These embodiments provide an area-denial munition capable of self-neutralization in a manner that is relatively safe, having a reduced risk of collateral or incidental damage to civilians, friendly military personnel, or other unintended targets of the munition.

For example, ordnance that remains on a battlefield poses a danger to civilians who may handle the ordnance. Further, these ordnances can also be repurposed or reutilized by enemy threats to be used against friendly military personnel, civilians, or other unintended targets. Some known area-denial munitions possess an ability to self-destruct after their deployed mission life has ended. However these current munitions pose serious problems when self-destructing as those that self-destruct do so by an indiscriminant and dangerous detonation reaction of the munition that can cause injury or fatality to innocent civilians that may be nearby. In addition, those that self-neutralize may leave an intact ordnance device that can be repurposed or reutilized by enemy threats to be used against friendly military troops and/or civilians.

As such, in various embodiments, the area-denial munition allows for the safe destruction of the deployed munition after it has served its mission life, but still allows for the full detonation of the munition in order to function as an area-denial device when required.

One or more embodiments are directed to an area-denial munition configured for self-neutralization of an explosive ordnance. In various embodiments the munition includes a housing including a chassis defining a sidewall for at least partially containing the explosive ordnance, the chassis defining one or more openings in the housing such that the housing is an at least partially open structure exposing an interior to an ambient environment of the munition. In certain embodiments the munition includes a detonation module including a detonation initiator configured to cause a detonation of the explosive ordnance, and a deflagration module coupled with the explosive ordnance, the deflagration module including a deflagration initiator configured to cause a deflagration of the explosive ordnance for deflagration of the explosive ordnance. In various embodiments the munition controller includes a processor and memory. In certain embodiments the memory includes a set of instructions executable by the processor to cause the munition controller to receive, via the munition control circuitry, instructions to self-neutralize the explosive ordnance. In some embodiments the instructions are executable by the processor to instruct, via the munition control circuitry, the deflagration module to activate the deflagration initiator, and cause, via the deflagration initiator, a deflagration of the explosive ordnance.

One or more embodiments of the disclosure are directed to a method of operating an area-denial munition configured for self-neutralization of an explosive ordnance. In various embodiments the munition includes a housing including a chassis defining a sidewall for at least partially containing the explosive ordnance, the chassis defining one or more openings in the housing such that the housing is an at least partially open structure exposing an interior to an ambient environment of the munition, a detonation module including a detonation initiator, a deflagration module including a deflagration initiator, and munition control circuitry.

In various embodiments the method includes receiving, via the munition control circuitry, instructions to self-neutralize the explosive ordnance. In one or more embodiments the method includes instructing, via the munition control circuitry, the deflagration module to activate the deflagration initiator. And in certain embodiments the method includes causing, via the deflagration initiator, a deflagration of the explosive ordnance.

Various embodiments of the disclosure are directed to an area denial system for deployment in a region, the area denial system including a plurality of munitions, one or more sensor devices, a command and control unit, and one or more gateway devices. In one or more embodiments the plurality of munitions, the one or more sensor devices, and the command and control unit are networked together via the one or more gateway devices in an area denial network. In various embodiments each of the plurality of munitions are configured for self-neutralization of an explosive ordnance.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
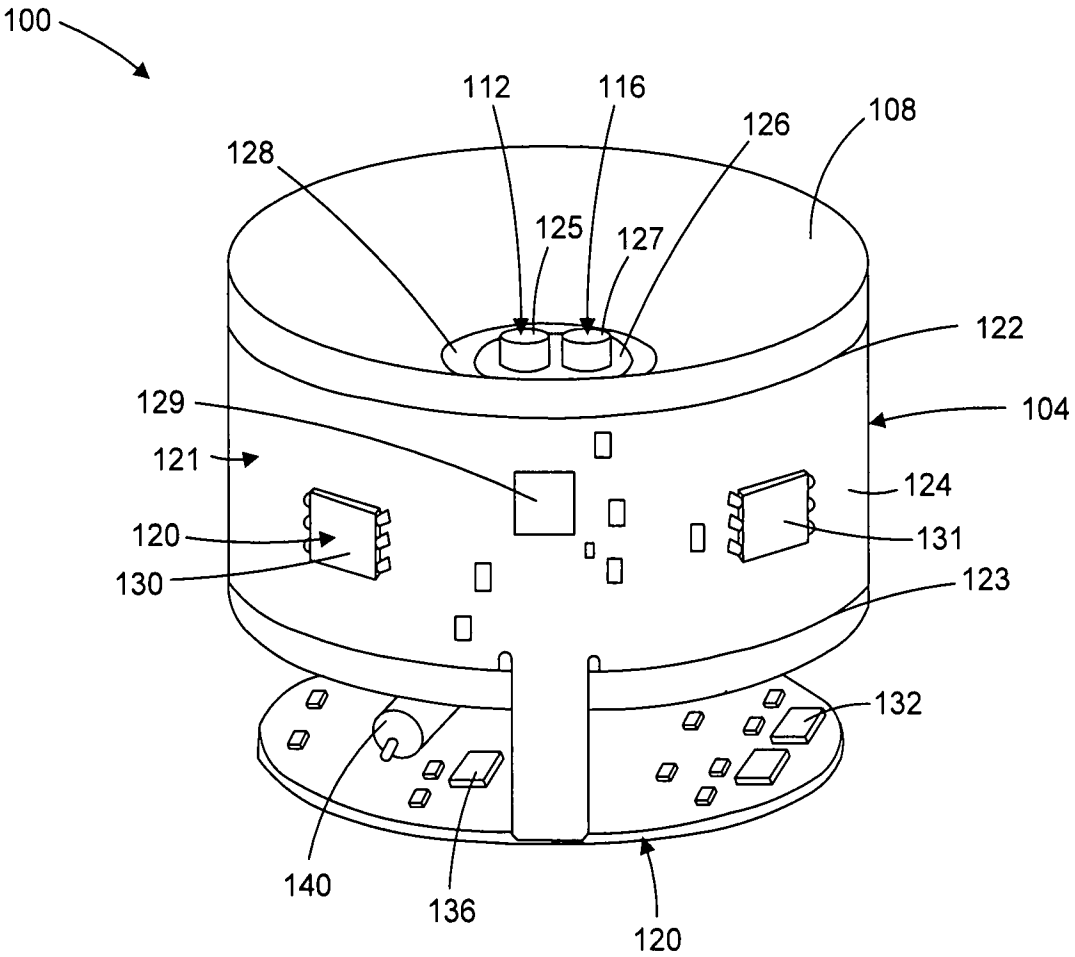
FIG. 1 depicts an area-denial munition, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1 an area-denial munition 100 is depicted, according to one or more embodiments of the disclosure. In various embodiments, the munition 100 includes a housing 104, an explosive ordnance 108, a detonation module 112, a deflagration module 116, and various electronic circuitry 120 for munition operation/control.

In one or more embodiments the housing 104 provides a structure for containing and/or supporting various elements of the munition 100 including the explosive ordnance 108 and/or other operational components. Depicted in FIG. 1, the housing 104 has a cylindrical shape or a generally cylindrical shape defined by a chassis 121. However, it is contemplated that housing 104 can have any suitable shape for an area-denial device depending on the preferences of a user. For example, in certain embodiments housing 104 could be a rectangular prism, cuboid, or other shape.

In various embodiments housing 104 is an open or non-enclosed structure including one or more openings defined by the chassis 121. As such, in various embodiments the interior of the housing 104 is exposed to the ambient environment for release of stored potential energy during an explosion or deflagration of the explosive ordnance 108, described further below. For example, depicted in FIG. 1, chassis 121 includes at least two openings in the housing defined by a top annular edge 122 and a bottom annular edge 123. In certain embodiments, chassis 121 could include additional openings such as openings in sidewall 124 of chassis 121 exposing portions of the explosive ordnance 108.

In certain embodiments explosive ordnance 108 can include any suitable high explosive. As used herein, the term "high explosive" refers to any type of explosive material capable of detonation to release stored potential energy. Furthermore, as used herein the term "detonation", "detonate", or the like, describes a chemical reaction that occurs within the material that releases stored potential energy, where the chemical reaction moves through the material at rate that is faster than the speed of sound (e.g. 340 meters per second).

In addition, as used herein the term "high explosive" is not intended limit the materials available to the explosive ordnance 108 to those which are solely capable of detonation. For example, the term "high explosive" is specifically intended to include materials that are also capable of combustion or deflagration in addition to detonation. As such, and described further below, in various embodiments the explosive ordnance 108 is capable of detonation under some conditions while also being capable of deflagration or combustion under other conditions.

In various embodiments explosive ordnance 108 is a secondary explosive, having less sensitivity, as compared to primary explosives, such that simple heat or shock to the explosive ordnance 108 will not generally cause an explosive chemical reaction to occur. Instead, in various embodiments, the explosive ordnance 108 is configured such that it generally requires an explosive initiator, such as the detonation module 112 or deflagration module 116, described further below, to cause an explosive chemical reaction in the ordnance 108.

In various embodiments, high explosives suitable for use as the explosive ordnance 108 include, but are not limited to, any qualified explosive in accordance with NAVSEAINST 8020.5C or STANAG 4170, or interim explosive that is going through or will be going through qualification. In addition, in various embodiments, the type, quantity, and other characteristics of explosive ordnance 108 selected is based on the purpose and/or desired capabilities of the munition 100.

In one or more embodiments, the detonation module 112 is configured to initiate an explosive reaction or detonation from the explosive ordnance 108 for functioning as an anti-personnel, anti-materiel, anti-armor, or other type of explosive area-denial device. In one or more embodiments the detonation module 112 includes an explosive initiator device 125. In various embodiments the initiator device 125 includes, but is not limited to, an exploding foil initiator (EFI), a low energy exploding foil initiator (LEEFI), a blasting cap, and an exploding-bridgewire detonator (EBW).

In various embodiments, the initiator device 125 is configured to cause an explosive detonation of the explosive ordnance 108. For example, where the initiator device 125 is configured as an EFI or LEEFI, the detonation of the ordnance 108 is caused by an explosive vaporization of a thin metal wire or strip, by driving a relative large voltage or current through the metal wire or strip. In certain embodiments, this voltage is selected in a range between and including about 500 volts and about 1500 volts. In various embodiments, explosive vaporization of the thin metal wire or strip in the EFI or LEEFI generates a shock wave, heat, or other sufficient force to cause a denotation in the explosive ordnance 108.

In one or more embodiments, the deflagration module 116 is configured to initiate a combustion or deflagration of explosive ordnance 108 without also initiating an explosive reaction or detonation from the explosive ordnance 108. In various embodiments the deflagration module 116 includes a deflagration initiator device 127. In various embodiments, the deflagration initiator 127 is an exploding foil initiator (EFI), a low energy exploding foil initiator (LEEFI), or other voltage based initiator device, as described above. In addition, in certain embodiments the deflagration device includes a pyrotechnic primer 126. In various embodiments the pyrotechnic primer 126 is a material coupled with the initiator device such that the initiator device is configured to cause a burning or deflagration reaction of the primer 126. In various embodiments, pyrotechnic primer 126 includes but is not limited to, BKNO3 (boron potassium nitrate), thermite, or any pyrotechnic material with an energy output capable of initiating a burning or deflagration reaction in explosive ordnance 108.

In various embodiments, the deflagration initiator device 127 is configured to cause deflagration or combustion of the pyrotechnic primer 126. For example, where the initiator device 127 is configured as an EFI or LEEFI, deflagration of the primer 126 is caused by vaporization of a thin metal wire or strip, by driving a voltage or current through the metal wire or strip. In various embodiments, the voltage or current driven through the EFI or LEEFI of the deflagration initiator 127 is reduced relative to that of the initiator device 125. For example, in various embodiments the voltage for the deflagration initiator 127 is reduced at a range between and including 40% to 70% of the voltage of initiator device 125. In such embodiments, deflagration module 116 is configured to restrict or limit the power of the deflagration initiator 127 to a point such that the deflagration module 116 is capable of initiating a deflagration of the pyrotechnic primer 126, while also being restricted from unintentionally causing an explosive reaction of the pyrotechnic primer 126 or, in some instances, the explosive ordnance 108.

In one or more embodiments, the pyrotechnic primer 126 may be disposed in a centrally formed cavity 128 in the munition 100. As such, in various embodiments, the pyrotechnic primer 126 is strategically positioned within the explosive ordnance for optimal energy transfer between the primer 126 and the explosive ordnance 108 during, for example, a deflagration of the pyrotechnic primer 126 to cause a deflagration of the explosive ordnance 108.

In some embodiments, the centrally formed cavity 128 could include a primer charge in addition to the pyrotechnic primer 126, where the detonation module 112 is configured to a cause a detonation of the primer charge to cause a detonation of the explosive ordnance 108. In certain embodiments the primer charge includes, but is not limited to, any qualified explosive in accordance with NAVSEAINST 8020.5C or STANAG 4170, or interim explosive that is going through or will be going through qualification.

While in various embodiments the initiator device 125 and deflagration initiator device 127 are described as voltage based initiators, in various embodiments the initiator devices 125, 127 could be a blasting cap, exploding-bridgewire detonator (EBW) or other non-voltage based initiator device. In such embodiments the deflagration initiator device 127 can include a primer charge that generates a chemical or explosive reaction that is reduced or weakened as compared to the initiator device 125 in order to result in a deflagration of the explosive ordnance 108. For example, in some embodiments the deflagration initiator device 127 may include a shaped charge that will produce a jet capable of initiating a burning reaction in the explosive ordnance 108 but that will not substantially initiate a detonation.

Further, while initiator device 125 and deflagration initiator device 127 are depicted as separate elements in the munition 100, in various embodiments the munition 100 could include a single initiator device configured to cause detonation or deflagration of the explosive ordnance 108. For example, in various embodiments, where the initiator is configured as an EFI or LEEFI, control circuitry of the munition 100 could be configured to selectively apply a particular voltage or range of voltages in order to achieve a detonation or deflagration, as described above.

In certain embodiments the deflagration of the explosive ordnance 108 may be used to reduce the amount of overall explosive material in the munition 100 before detonation of the explosive ordnance 108 by the detonation module 112. Consequently, the reduction of the amount of overall explosive ordnance 108 in the munition 100 through deflagration of a portion of the explosive ordnance 108 enables the output of the munition 100 to be selectively reduced. Additional discussion of selective reduction of explosive ordnance in a munition can be found in U.S. Pat. No. 8,931,415, incorporated by reference herein in its entirety for all purposes.

In one or more embodiments, the housing 104 includes the plurality of electronic circuitry 120 and/or devices for operation and control of the area-denial munition 100. For example, in various embodiments the electronic circuitry 120 includes a munition controller 129, an electronic safe and arm device (ESAD) 130, fuzing controller 131, sensor devices 132, transceiver 136, power supply 140, and other electronic componentry.

Described further below, the munition controller 129 is a collection of one or more logical devices, memory, and/or other circuitry for control of the area-denial munition 100. In various embodiments the ESAD 130 is an electronic system configured to provide fuzing safety for the munition 100 to prevent unintended detonation/deflagration during handling and emplacement. Described further below, in various embodiments the ESAD 130 can be additionally configured to provide various criteria for the fuzing controller 131 for preventing detonation/deflagration of the explosive ordnance 108 until certain pre-determined conditions set by the ESAD 130 are satisfied.

In various embodiments, the fuzing controller 131 is collection of one or more logical devices memory, and/or other circuitry for operation and control of the detonation module 112 and deflagration module 116. As such, and described further below, in various embodiments fuzing controller 131 is configured to control the detonation of the explosive ordnance 108, for example, to eliminate a target for the munition 100, or, as an additional example, to control the deflagration of the explosive ordnance 108, for example, to disarm the explosive ordnance 108 and the munition 100.

Sensor devices 132, in various embodiments, include one or more of cameras, thermographic imaging devices, magnetic sensors, motion sensors, tripwires, microphones, and any other suitable sensor for detecting and/or tracking a target for the area-denial munition 100. In certain embodiments, sensor devices 132 can be configured to detect the presence of and/or track the position of one or more of animal, personnel, vehicle, mechanical, or other targets, relative to the position of the sensor device 132. In certain embodiments, sensor device 132 is able to autonomously differentiate between personnel and vehicle targets.

Transceiver 136, in various embodiments is a communication device configured for wired and/or wireless communication between one or more other area-denial munitions 100, external sensors, network gateway devices, other external devices or componentry, or communication with a human operator, such as when used with "man-in-the-loop" munition control systems. For example, and described further below, in various embodiments transceiver 136 is configured for wireless communication with various elements of an area-denial system. In certain embodiments transceiver 136 is configured for wired and/or wireless communication with other elements of the munition 100.

Wireless communication, as referred to herein, is any form of communication where data is transmitted as a signal through the air. As such, in certain embodiments, transceivers 136 can be configured for various forms of wireless communication including Wi-Fi, Li-Fi, Bluetooth®, radio waves, or other wireless signals. Wired communication, as used herein, is any form of communication where data is transmitted as a signal across a wire, optical fiber, or other physical medium.

In certain embodiments, transceiver 136 is configured for a combination of wired and wireless communication. For example, in some embodiments, the transceiver 136 could establish a wireless signal between some munitions while utilizing wired connections between other munitions or other components of an area-denial system. In some embodiments, the transceivers 136 could use both wireless and wired connections to between elements of the system as a redundancy in case of wireless or wired communication error.

Figure 2A:
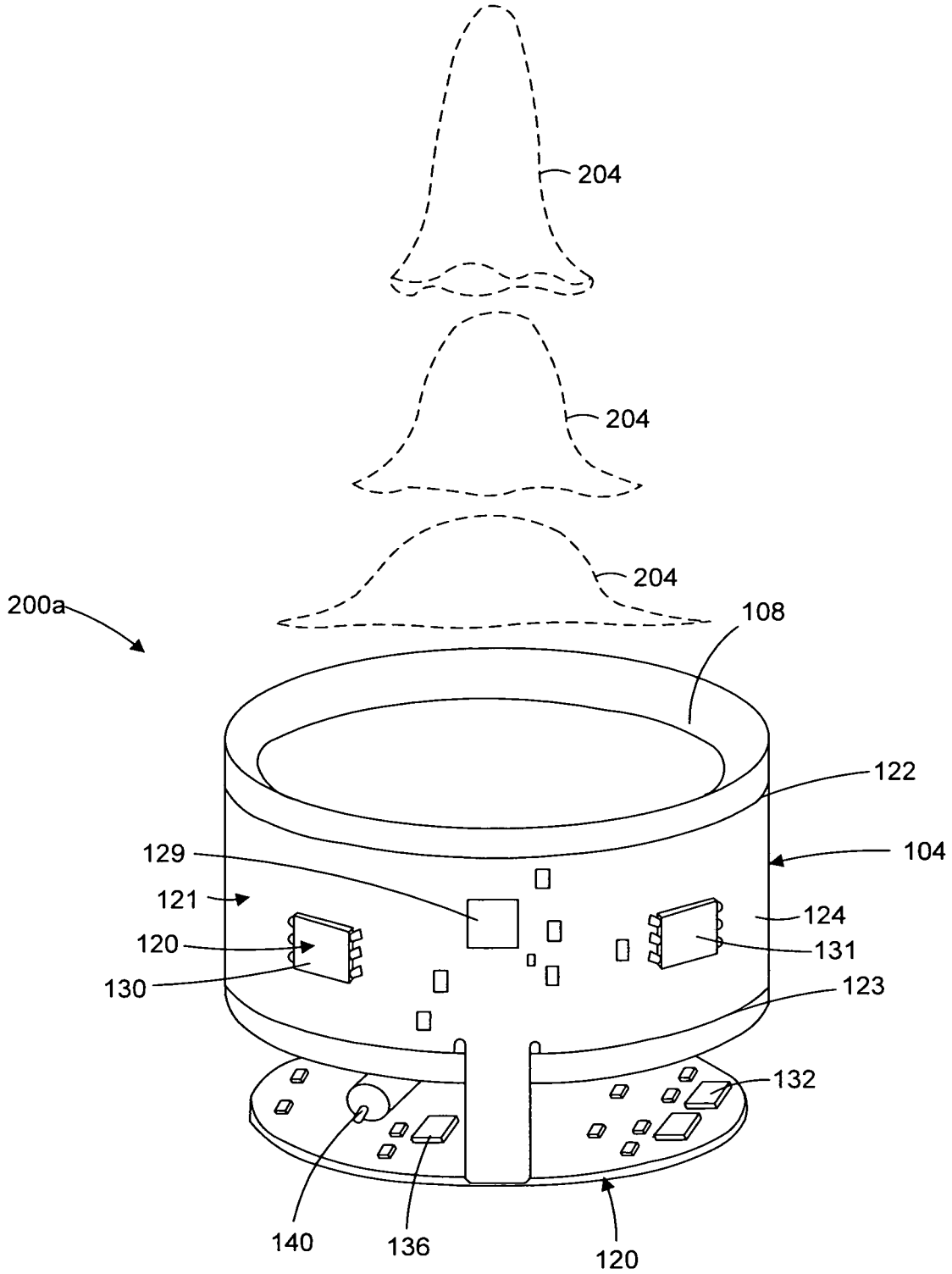
FIGS. 2A-2B depict area denial munitions in states of detonation and deflagration, according to one or more embodiments of the disclosure.
Figure 2B:
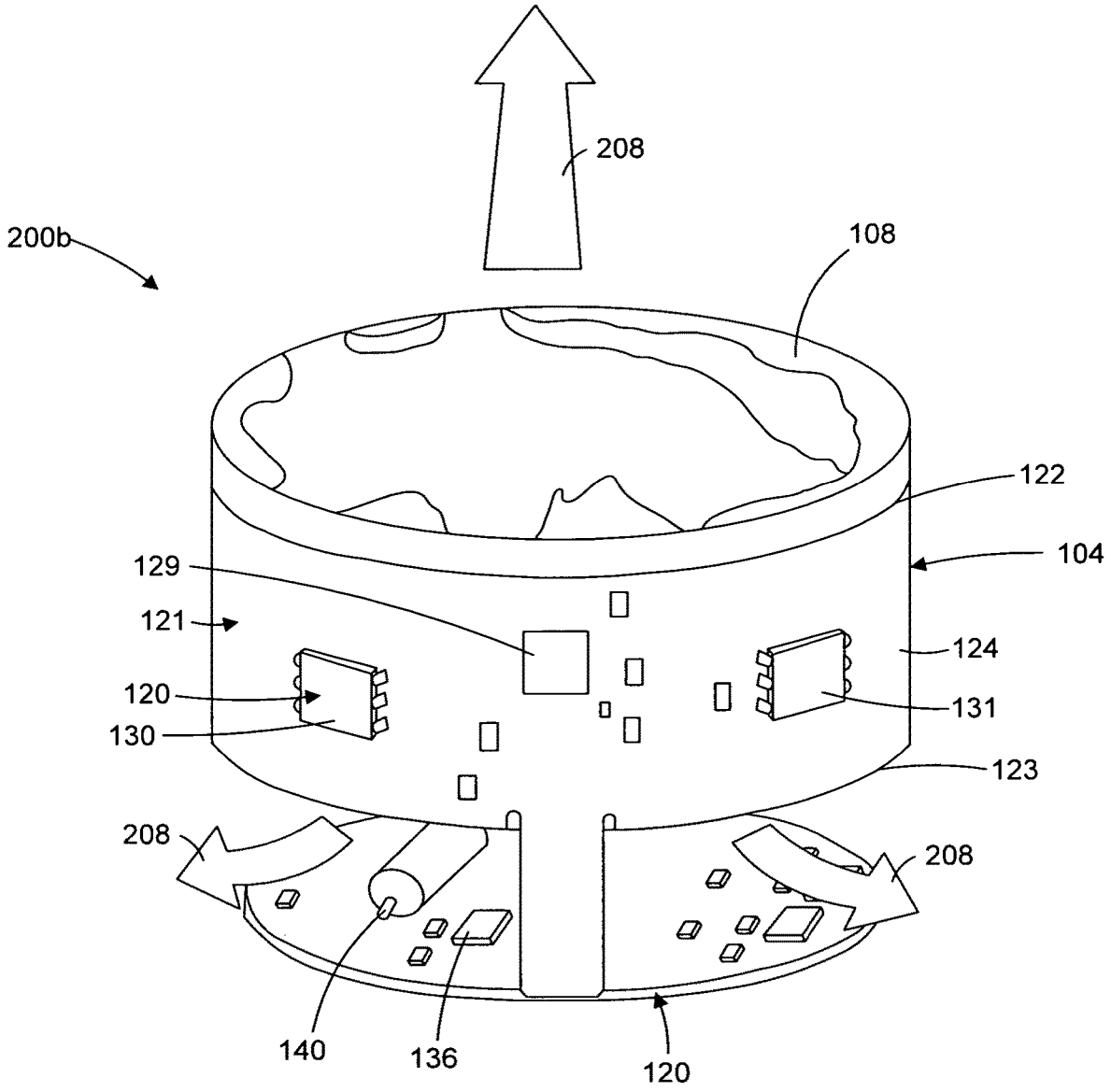

Referring to FIGS. 2A-2B, depicts area denial munitions 200*a*, 200*b* in states of detonation and deflagration, according to one or more embodiments of the disclosure. Area denial munitions 200*a*, 200*b* are substantially similar to area denial munition 100, depicted in FIG. 1. As such, like elements are identified with like reference numerals. For example, in various embodiments munitions 200*a*, 200*b* includes housing 104, chassis 121 having a top annular edge 122 and bottom annular edge 123, sidewall 124, and various electronic circuitry 120 including munition controller 129, electronic safe and arm device (ESAD) 130, fuzing controller 131, sensor devices 132, transceiver 136, and power supply 140.

FIG. 2A depicts the area denial munition 200*a* in a state of detonation, according to one or more embodiments. In operation, the fuzing controller 131 is configured to control the detonation module 112 (FIG. 1) to initiate an explosive reaction from the explosive ordnance 108 for functioning as an anti-personnel, anti-material, anti-armor, or other type of explosive area-denial device, as described above.

As such, in various embodiments, fuzing controller 131 is configured to provide a voltage to an EFI or LEEFI initiator device to cause a denotation of explosive ordnance 108. Depicted in FIG. 2A, in operation, explosive ordnance 108 detonates and drives a metallic liner 204 upwardly by detonation of the explosive ordnance 108 for producing anti-materiel or anti-armor effects. However, in various embodiments, the explosive ordnance 108 could be configured for anti-personnel effects in addition or in lieu of the anti-materiel or anti-armor configuration depicted in FIG. 2A.

FIG. 2B depicts the area denial munition 200*b* in/subsequent to a state of deflagration, according to one or more embodiments. In operation, the fuzing controller 131 is configured to control the deflagration module 116 (FIG. 1), to initiate a combustion or deflagration of explosive ordnance 108 without also initiating an explosive reaction or detonation from the explosive ordnance 108, as described above.

As such, in various embodiments, fuzing controller 131 is configured to provide a voltage to an EFI or LEEFI initiator device to cause an exothermic chemical reaction in a pyrotechnic primer 126 and cause a deflagration of the explosive ordnance 108. Depicted in FIG. 2B, in operation, explosive ordnance 108 begins to combust, producing heat and/or other residue that is released into the ambient environment and away from the munition 100 via openings in the housing 104 defined by the annular upper and lower edges 122, 123 in chassis 121 (indicated in FIG. 2B by arrows 208). Because the housing 104 is open to the ambient environment, in various embodiments the deflagration of the explosive ordnance 108 is a substantially non-pressurized event. As such, in various embodiments, heat, gasses, residue and other elements resulting from the deflagration escape from the housing 104 at a rate that is equal to or greater than the rate of pressure build-up within the housing 124.

Figure 3:
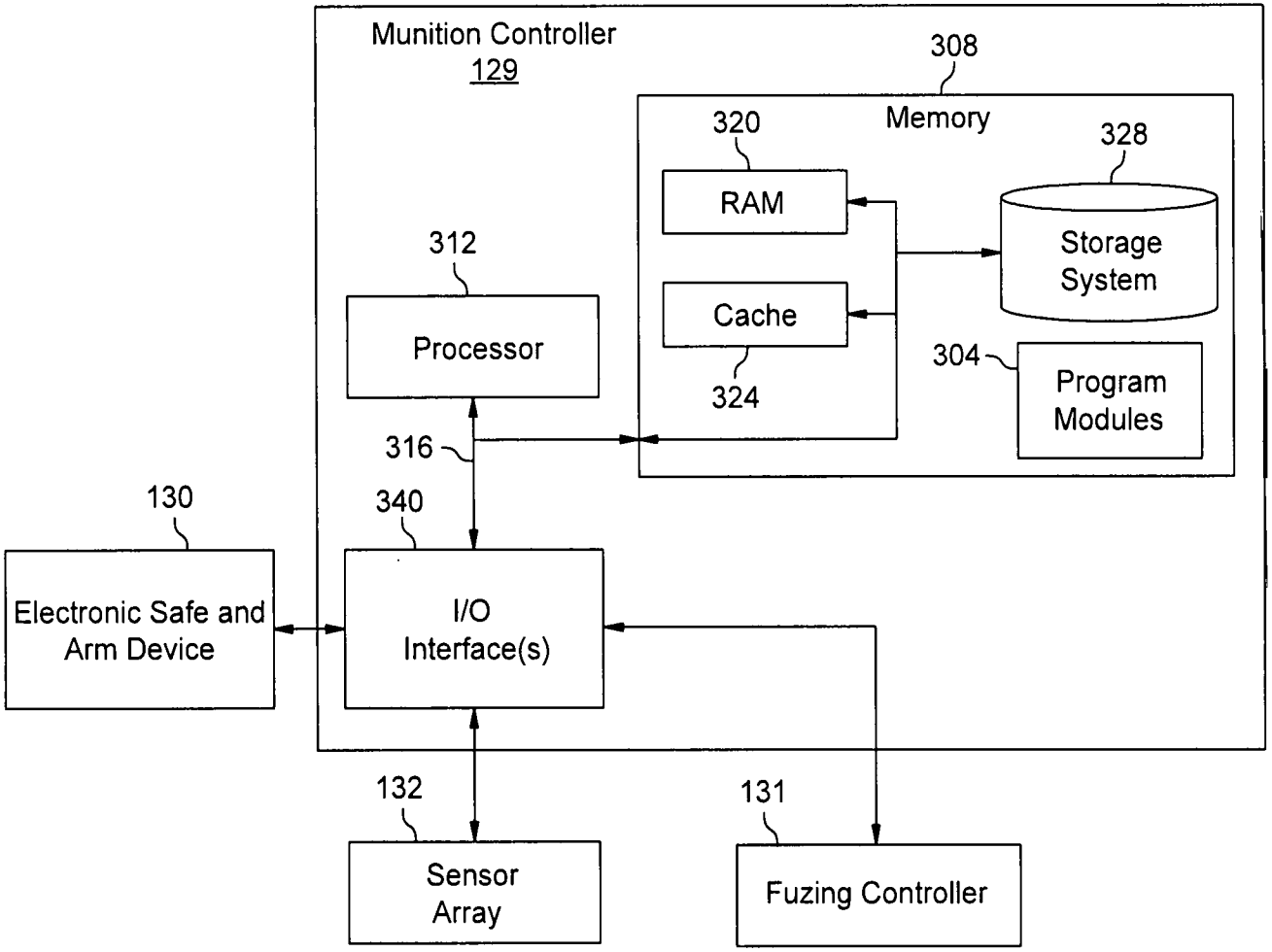
FIG. 3 depicts a block diagram of a munition controller for an area-denial munition, according to one or more embodiments of the disclosure.

Referring to FIG. 3, a block diagram of the munition controller 129 is depicted, according to one or more embodiments of the disclosure. Munition controller 129 may be operational with general purpose or special purpose computing system environments or configurations for target interception, according to one or more of the embodiments herein.

Examples of computing systems, environments, and/or configurations that may be suitable for use with munition controller 129 include, but are not limited to, personal computer systems, server computer systems, handheld or laptop devices, multiprocessor systems, mainframe computer systems, distributed computing environments, and the like.

Munition controller 129 may be described in the general context of a computer system, including executable instructions, such as program modules 304, stored in system memory 308 being executed by a processor 312. Program modules 304 may include routines, programs, objects, instructions, logic, data structures, and so on, that perform particular tasks or implement particular abstract data types. Program modules 304 may be practiced in distributed computing environments where tasks are performed by remote processing devices that are linked through a network. In a distributed computing environment, program modules 304 may be located in both local and remote computer system storage media including memory storage devices. As such, in various embodiments munition controller 129 can be configured to execute various program modules 304 or instructions for executing various embodiments of the disclosure. For example, in various embodiments munition controller 129 can be configured to operate the munition for anti-personnel and/or anti-vehicle area-denial. In addition, in various embodiments munition controller 129 can be configured to disarm the munition, via the fuzing controller 131, by a deflagration process to eliminate explosive ordnance contained in the munition.

In FIG. 3, munition controller 129 is shown in the form of a general-purpose computing device. The components of the munition controller 129 may include, but are not limited to, one or more processors 312, memory 308, and a bus 316 that couples various system components, such as, for example, the memory 308 to the processor 312. Bus 316 represents one or more of any of several types of bus structures, including, but not limited to, a memory bus and/or memory controller, a peripheral bus, and a local bus using a suitable of bus architecture.

In one or more embodiments, munition controller 129 includes a variety of computer readable media. Such media may be any available media that is accessible by the munition controller 129. In one or more embodiments, computer readable media includes both volatile and non-volatile media, removable media, and non-removable media.

Memory 308 may include computer readable media in the form of volatile memory, such as random access memory (RAM) 320 and/or cache memory 324. Munition controller 129 may further include other volatile/non-volatile computer storage media such as hard disk drive, flash memory, optical drives, or other suitable volatile/non-volatile computer storage media. By way of example, storage system 328, can be provided for reading from and writing to a non-removable, non-volatile media. Described further herein, memory 308 may include at least one program product having a set (e.g., at least one) of program modules 304 or instructions that are configured to carry out the functions of embodiments of the disclosure.

Munition controller 129 may also communicate with one or more external devices such as the ESAD 130, the fuzing controller 131, and sensor devices 132, via an I/O interface (s) 340 for transmitting and receiving sensor data, instructions, or other information to and from the munition controller 129. For example, in one or more embodiments I/O interface 340 includes a transceiver for wirelessly communicating with the ESAD 130 and fuzing controller 131. As such, in one or more embodiments, I/O interface 340 can communicate with munitions, elements from other munitions, or other devices via wireless communication.

Figure 4:
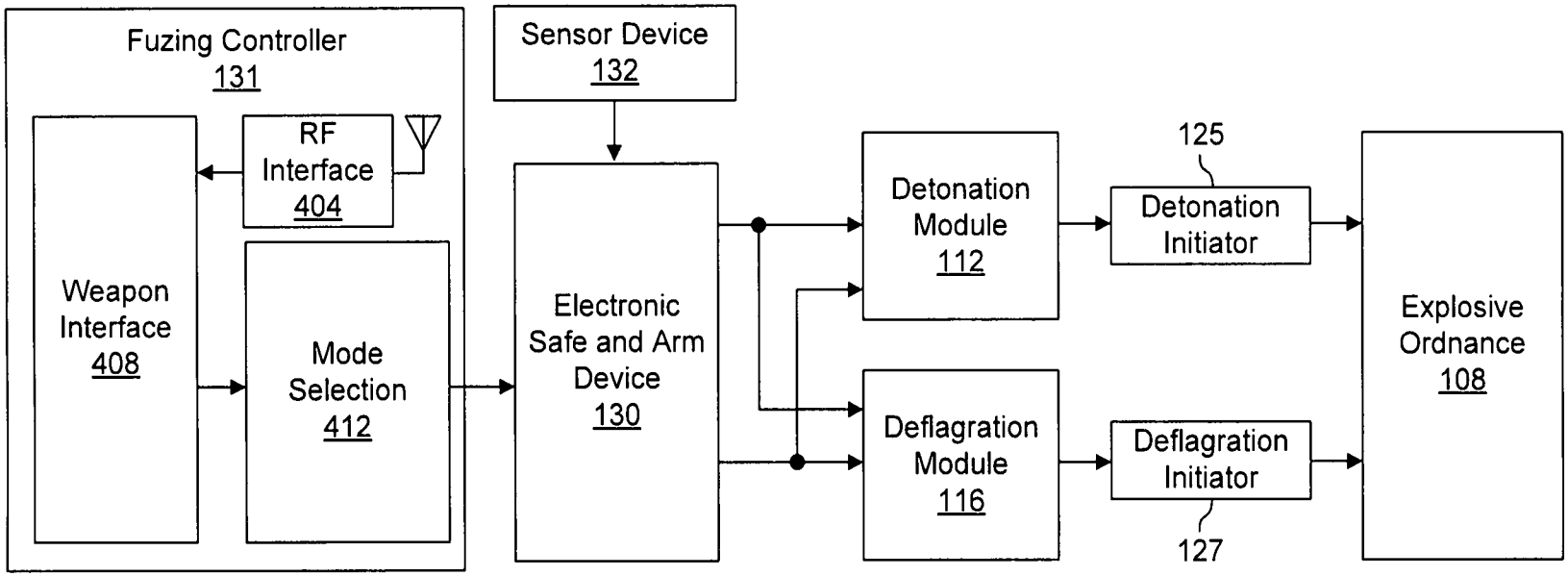
FIG. 4 depicts a block diagram of a fuzing controller and electronic safe and arm device for an area-denial munition, according to one or more embodiments of the disclosure.

Referring to FIG. 4, a block diagram of the fuzing controller 131 and electronic safe and arm device 130 is depicted, according to one or more embodiments of the disclosure. In various embodiments, the fuzing controller includes a radio-frequency (RF) device 404, weapon interface circuitry 408, and mode selection circuitry 412.

In various embodiments RF device 404 is substantially similar to the transceiver or I/O interface 340 of the munition controller 129 (FIG. 3). As such, in various embodiments RF device 404 is configured to transmit and/or receive various data, including instructions, from the munition controller 129 or other systems external to the munition. As such, in various embodiments RF device 404 is configured for wireless and/or wireless communication.

In one or more embodiments weapon interface circuitry 408 is collection of one or more logical devices memory, and/or other circuitry for operation and control of the detonation module 112 and deflagration module 116. In various embodiments weapon interface circuitry 408 is configured to receive various instructions indicating a command to detonate or deflagrate the explosive ordnance 108, as described above. As such, in various embodiments weapon interface circuitry is configured to receive these instructions and, in response, to operate one or more of the detonation module 112 and deflagration module 116.

In addition, in various embodiments fuzing controller 131 includes mode selection circuitry 412 such that he fuzing controller 131 is configured for a dual-mode method of operation where detonation or deflagration is selectable by weapon interface circuitry 408. In various embodiments, the weapon interface circuitry 408 is instructable to select either of the detonation or deflagration modes by receiving instructions from the munition controller 129 (FIG. 3) and/or a human operator, such as when the munition is configured for man-in-the-loop control.

In various embodiments, instructions to detonate or deflagrate the explosive ordnance 108 are first transmitted to the Electronic Safe and Arm Device (ESAD) 130. As described above, in various embodiments ESAD 130 provides fuzing safety for handling and emplacement of a munition, and controls fuzing arming when general arming criteria are met. Under control of either a remote controller (i.e. man-in-the-loop) or an autonomous controller internal to the munition, the ESAD will either initiate a detonation or deflagration reaction of the munition's explosive ordnance 108 as determined by the Mode Selection circuitry 412.

In various embodiments, the arming criteria are set of message filters used by the ESAD 130 to determine which instructions or messages are transmitted through the ESAD and to the detonation or deflagration modules 112, 116. Put another way, the arming criteria is a set of rules/conditions that determine whether the instructions from the fuzing controller 131 are transmitted to its intended destination or whether the instructions are discarded for failing to satisfy one or more of the rules/conditions. In addition, in various embodiments the ESAD 130 can be in communication with one or more sensor devices 132 of the munition to determine whether the arming criteria are satisfied. As such, in various embodiments the arming criteria are used prevent unintentional detonation and/or deflagration of the explosive ordnance to assist in placement of the munitions and assist in reduction or elimination lethal effects on an unintended target.

In various embodiments, the arming criteria can include various criteria for determining whether to transmit instructions from the fuzing controller 131. For example, in one or more embodiments, the arming criteria could include determining the physical orientation of the munition and acceleration of the munition (e.g. determining whether the munition is being moved or is stationary), determining whether firing authorization credentials have been provided, determining whether a target is within some threshold distance from a munition, whether the sensor data confidence level has dropped below a preset threshold, or whether a probability of successful engagement with the target has dropped outside of a threshold. Discussion of various criteria for arming/fuzing/deflagration can be found, for example, in U.S. Pat. No. 10,054,404, titled "Area Denial Communication Latency Compensation", incorporated by reference herein in its entirety for all purposes.

In various embodiments, if the various arming criteria are satisfied the ESAD 130 is configured to transmit instructions from the fuzing controller 131 to one or more of the detonation module 112 and deflagration module 116. As described above, in various embodiments the modules 112, 116 include initiators 125, 127 configured as a EFI or LEEFI. In various embodiments, the detonation initiator 125 utilizes a secondary explosive as an output to achieve a detonation of the explosive ordnance 108. In various embodiments the deflagration initiator utilizes an exothermic chemical reaction (heat) as the output to achieve a deflagration of the explosive ordnance 108.

Figure 5:
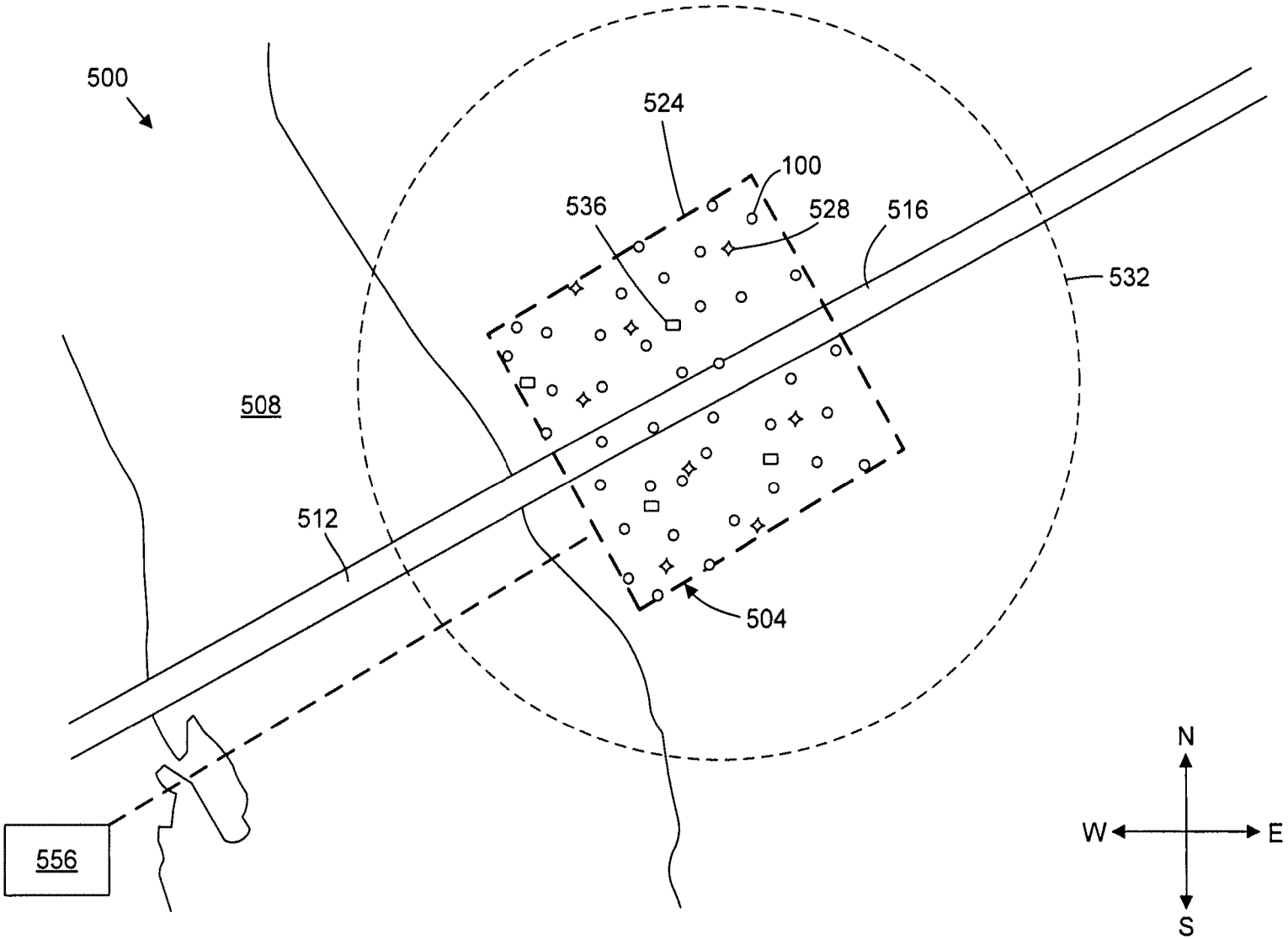
FIG. 5 depicts a top down plan view of a geographic region 500 with an area denial system 504, according to one or more embodiments of the disclosure.

FIG. 5 depicts a top down plan view of a geographic region 500 with an area denial system 504 including a plurality of munitions 100, according to one or more embodiments of the disclosure. Geographic region 500 represents a hypothetical region including various geographical and/or man-made features. For example, FIG. 5 depicts a geographic region 500 including a river 508 with a bridge 512 and road 516. To deny enemy maneuvers across the bridge 512, an obstacle in the form of the area denial system 504 is deployed over a portion of the road 516 and adjacent to the bridge 512 thereby blocking and/or disrupting enemy movements across the river 508.

In various embodiments, the area denial system 504 includes a plurality of munitions 100 which are deployed in the geographic region 500 and define an obstacle region 524. For purposes of illustration, obstacle region 524 is denoted by a dashed rectangular region that includes each of the plurality of munitions 100. In one or more embodiments, the munitions 100 include anti-vehicle munitions that are configured to engage with various types of armored or unarmored vehicles. In certain embodiments, munitions 100 include anti-personnel munitions that are configured to engage with enemy personnel. In some embodiments, the munitions 100 include both anti-vehicle and anti-tank munitions, or include munitions that are configured with capability to engage with both vehicles and with personnel. In one or more embodiments, munitions 100 are scatterable munitions that are remotely deployable such as, for example, by artillery shell or aircraft. In certain embodiments, munitions 100 are hand deployable munitions.

Obstacle region 524 is depicted in FIG. 5 as a 100 meter (m) by 100 m rectangular square having a munition density of about 0.004 munitions per square meter portion of the obstacle region 524. However, in various embodiments, obstacle region 524 can be any suitable size with any suitable munition density. For example, in various embodiments, munitions 100 can be added, upgraded, or removed from the area denial system 504 to alter the size of the obstacle region 524, alter the munition density, or alter the capabilities of the area denial system 504 to suit various system objectives.

In one or more embodiments, area denial system 504 includes sensor devices 528. Sensor devices 528, in various embodiments, includes one or more of cameras, thermographic imaging devices, magnetic sensors, motion sensors, tripwires, microphones, and any other suitable sensor for detecting and/or tracking a target. In certain embodiments, sensor devices 528 can be configured to detect the presence of and/or track the position of one or more of animal, personnel, vehicle, mechanical, or other targets, relative to the position of the sensor device 528. In certain embodiments, sensor devices 528 are able to autonomously differentiate between personnel and vehicle targets.

In various embodiments, the sensor devices 528 have a sensor range, depicted in FIG. 5 as a dashed circle 532 that denotes the area of the geographic region 500 where sensor devices 528 are cable of detecting and/or tracking targets. In one or more embodiments, the sensor range will extend outside of the obstacle region 524 to detect targets as they approach the obstacle region 524 and prior to entry into obstacle region 524. In certain embodiments, once a target is detected, the sensor devices 528 are configured to then track the position of the target and continually update the system on the position and status of the target. In various embodiments, once a target is detected, the sensor devices 528 are configured to track the target until the target is either eliminated, leaves the detection range of the sensor devices 528, or otherwise becomes undetected by the sensor devices 528.

The sensor range is depicted in FIG. 5 as a circle 532 having a radius of about 150 meters. However, in various embodiments, the sensor range can have a range and/or shape that varies depending upon the position, number, and type of sensor devices 528. For example, certain sensor devices 528 may have different detection ranges compared to other sensors. Similarly, certain sensor devices 528 may have different positions in the geographic region 500. In addition, sensor devices 528 may be more numerous in some areas than in others. As such, the sensor range can have various shapes, such as rectangular, triangular, or other uniform or non-uniform shape that is based on the position, number, and type of sensor devices 528 in the system 504.

In one or more embodiments, area denial system 504 includes one or more gateway devices 536. Gateway devices 536 are networking nodes that are each configured as a router, switch, or gateway for allowing data communication between elements of the area denial system 504. As such, in one or more embodiments, the one or more gateway devices 536 provide for networking between the plurality of munitions 100, sensor devices 528, and other elements in area denial system 504.

In one or more embodiments, each of the gateway devices 536 are configured to maintain a network between some portion of the munitions 100 and the sensor devices 528 within the system 104. As such, in certain embodiments, the system 504 includes a plurality of the gateway devices 536 which are distributed in the geographic region 500 and which each handle the networking of different elements among the total number of elements in the system 504.

In various embodiments, munitions 100, sensor devices 528, and other elements can be assigned to network with particular gateway devices 536 within the system 504 based on various factors such as proximity, latency, redundancy, technical requirements/limitations of the gateway devices 536, and other factors. In some embodiments the gateway devices 536 can be included as a part of one or more of the munitions 100 and/or the sensor devices 528.

In various embodiments, gateway devices 536 are configured for wireless communication between elements of the system 504. As such, in certain embodiments, gateway devices 136 can various forms of wireless communication including Wi-Fi, Li-Fi, Bluetooth®, radio waves, or other wireless signals. In certain embodiments, the gateway devices 536 are configured for wired communication. In certain embodiments, the gateway devices 536 are configured for a combination of wired and wireless communication. For example, in some embodiments, the gateway devices 536 could establish a wireless signal between various munitions while utilizing wired connections between other gateway devices 536. In some embodiments, the gateway devices 536 could use both wireless and wired connections to between elements of the system as a redundancy in case of wireless or wired communication error.

In one or more embodiments, the area denial system 504 includes a command and control unit 556. In various embodiments, command and control unit 556 is a control system or computer configured for control of the plurality of munitions 100, sensor devices 528, and/or other devices in the area denial system 504. As such, in various embodiments, the command and control unit 556 is networked with the plurality of munitions 100 and sensor devices 528 for communication via the one or more of the gateway devices 536. In one or more embodiments, the command and control unit 556 is located away from the obstacle region 524 and is additionally configured for remote control of the area denial system 504.

In some embodiments the command and control unit 556 can be a relatively short distance from the obstacle region 524. For example, depicted in FIG. 5, command and control unit 556 is depicted less than 200 m from the obstacle region 524. However, the command and control unit 556 can be located any suitable distance from the obstacle region 524. For example, in certain embodiments, the command and control unit 556 is located between ten to one hundred kilometers from the obstacle region 524. In some embodiments, the command and control unit 556 is located between ten to two hundred kilometers from the obstacle region 524. In embodiments, the command and control unit is at least 20 kilometers from the obstacle region. In embodiments, the command and control unit is at least 100 kilometers from the obstacle region. However, in certain embodiments the command and control unit 556 can be positioned a shorter distance or longer distance from the obstacle region 524. In various embodiments, the command and control unit 556 can utilize various long haul network relay options for long range communication with the obstacle region 524. For example, the command and control unit 556 can utilize ground relays, airborne relays, or space based relays, such as low earth orbit communication satellites to relay communications back and forth between the command and control unit 556 and the obstacle region 524.

Figure 6:
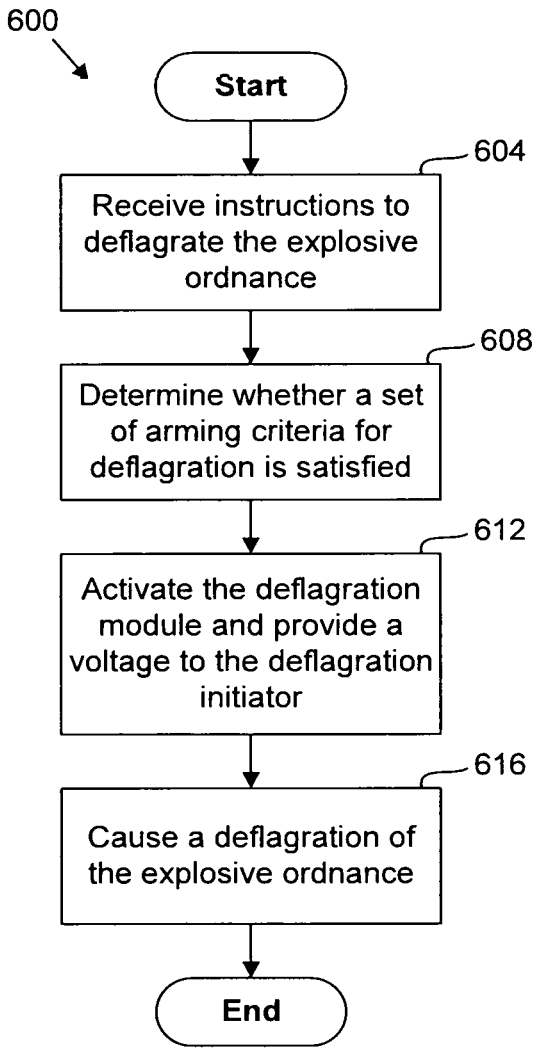
FIG. 6 depicts a method of operation for an area-denial munition, according to one or more embodiments of the disclosure.

Referring to FIG. 6 a method 600 of operation of an area-denial munition is depicted, according to one or more embodiments of the disclosure. In one or more embodiments, in operation 604, the method 600 includes receiving instructions to deflagrate the explosive ordnance. In one or more embodiments, in operation 608, the method 600 includes determining whether a set of arming criteria for deflagration is satisfied. As described above, in various embodiments an ESAD can determine a variety of rules/conditions for deflagration. In one or more embodiments, in operation 612, the method 600 includes activating the deflagration module. In various embodiments by activating the deflagration module a voltage is transmitted to a deflagration initiator which is configured to cause an exothermic reaction to initiate a deflagration-type chemical reaction in the explosive ordnance. In one or more embodiments, in operation 616, the method 600 includes causing the deflagration of the explosive ordnance via the deflagration initiator.

In addition to the above, U.S. Pat. Nos. 8,832,244; 8,836,503; 8,812,654; 7,305,467; and 5,489,909, are each incorporated herein by reference in their entirety for all purposes.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A method of operating an area-denial munition configured for self-neutralization of an explosive ordnance, the munition including a housing including a chassis defining a sidewall for at least partially containing the explosive ordnance, the chassis defining one or more openings in the housing such that the housing is an at least partially open structure exposing an interior to an ambient environment outside of the munition, the munition further including a detonation module including a detonation initiator, a deflagration module including a deflagration initiator coupled with a pyrotechnic primer, and munition control circuitry, where the detonation initiator is one of an exploding foil initiator (EFI) and a low energy exploding foil initiator (LEEFI), and is configured to initiate detonation of the explosive ordnance via a first voltage driven through a metal wire or strip and the deflagration initiator is one of an exploding foil initiator (EFI) and a low energy exploding foil initiator (LEEFI), and is configured to initiate deflagration of the explosive ordnance via a second voltage driven through a metal wire or strip, the second voltage being reduced relative to the first voltage by 40% to 70%, the method comprising:

receiving, via the munition control circuitry, instructions to deflagrate the explosive ordnance;

instructing, via the munition control circuitry, the deflagration module to activate the deflagration initiator; and causing, via the deflagration initiator, a deflagration of the explosive ordnance by driving the second voltage through the metal wire or strip.

2. The method of claim 1, wherein the one or more openings are defined by at least a top annular edge and a bottom annular edge of the sidewall.

3. The method of claim 1, wherein the sidewall defines one or more openings in the sidewall surrounding the explosive ordnance.

4. The method of claim 1, wherein deflagration of the explosive ordnance is a substantially non-pressurized in the munition such that pressure resulting from the deflagration escapes the housing via the one or more openings at a rate that is equal to or greater than a rate of pressure build-up within the housing.

5. The method of claim 1, wherein the deflagration initiator is coupled with at least one of the pyrotechnic primer and the explosive ordnance.

6. The method of claim 1, further comprising:

determining, via an electronic safe and arm device (ESAD), that a set of arming criteria for deflagration is satisfied;

wherein instructing the deflagration module to activate the deflagration initiator is in response to determining that the set of arming criteria for deflagration is satisfied.

7. The method of claim 6, wherein the set of arming criteria includes one or more of: the physical orientation of the munition, the acceleration of the munition, authorization credentials, target distance from the munition, sensor data confidence, and probability of successful engagement with a target.

8. The method of claim 6, wherein the set of arming criteria includes authorization credentials transmitted from a human operator.

9. An area-denial munition configured for self-neutralization of an explosive ordnance, the munition comprising:

a housing including a chassis defining a sidewall for at least partially containing the explosive ordnance, the chassis defining one or more openings in the housing such that the housing is an at least partially open structure exposing an interior to an ambient environment outside of the munition;

a detonation module coupled with the explosive ordnance, the detonation module including a detonation initiator configured to cause a detonation of the explosive ordnance, the detonation initiator being one of an exploding foil initiator (EFI) and a low energy exploding foil initiator (LEEFI), and is configured to initiate detonation of the explosive ordnance via a first voltage driven through a metal wire or strip; and a deflagration module coupled with a pyrotechnic primer, the deflagration module including a deflagration initiator configured to cause a deflagration of the pyrotechnic primer for deflagration of the explosive ordnance, the deflagration initiator being one of an exploding foil initiator (EFI) and a low energy exploding foil initiator (LEEFI), and configured to initiate deflagration of the explosive ordnance via a second voltage driven through a metal wire or strip, the second voltage being reduced relative to the first voltage by 40% to 70%; and a munition controller including a processor and memory, the memory including a set of instructions executable by the processor to cause the munition controller to:

receive, via the munition control circuitry, instructions to deflagrate the explosive ordnance;

instruct, via the munition control circuitry, the deflagration module to activate the deflagration initiator; and cause, via the deflagration initiator, a deflagration of the explosive ordnance.

10. The munition of claim 9, wherein the one or more openings are defined by at least a top annular edge and a bottom annular edge of the sidewall.

11. The munition of claim 9, wherein the sidewall defines one or more openings in the sidewall surrounding the explosive ordnance.

12. The munition of claim 9, wherein deflagration of the explosive ordnance is a substantially non-pressurized in the munition such that pressure resulting from the deflagration escapes the housing via the one or more openings at a rate that is equal to or greater than a rate of pressure build-up within the housing.

13. The munition of claim 9, wherein the deflagration initiator is coupled with at least one of the pyrotechnic primer and the explosive ordnance.

14. The munition of claim 9, wherein the set of instructions are executable by the processor to further cause the munition controller to:

determine, via an electronic safe and arm device (ESAD), that a set of arming criteria for deflagration is satisfied;

wherein instructing the deflagration module to activate the deflagration initiator is in response to determining that the set of arming criteria for deflagration is satisfied.

15. The munition of claim of claim 14, wherein the set of arming criteria includes one or more of: the physical orientation of the munition, the acceleration of the munition, authorization credentials, target distance from the munition, sensor data confidence, and probability of successful engagement with a target.

16. An area denial system for deployment in a region, the area denial system comprising:

a plurality of munitions;

one or more sensor devices; and a command and control unit, the plurality of munitions the one or more sensor devices and the command and control unit networked together via the one or more gateway devices in an area denial network;

wherein each of the plurality of munitions are configured for self-neutralization of an explosive ordnance, each of the munitions including:

a housing including a chassis defining a sidewall for at least partially containing the explosive ordnance, the chassis defining one or more openings in the housing such that the housing is an at least partially open structure exposing an interior to an ambient environment outside of the munition;

a detonation module coupled with the explosive ordnance, the detonation module including a detonation initiator configured to cause a detonation of the explosive ordnance, the detonation initiator being one of an exploding foil initiator (EFI) and a low energy exploding foil initiator (LEEFI), and is configured to initiate detonation of the explosive ordnance via a first voltage driven through a metal wire or strip; and a deflagration module coupled with a pyrotechnic primer, the deflagration module including a deflagration initiator configured to cause a deflagration of the pyrotechnic primer for deflagration of the explosive ordnance, the deflagration initiator being one of an exploding foil initiator (EFI) and a low energy exploding foil initiator (LEEFI), and configured to initiate deflagration of the explosive ordnance via a second voltage driven through a metal wire or strip, the second voltage being reduced relative to the first voltage by 40% to 70%; and a munition controller including a processor and memory, the memory including a set of instructions executable by the processor to cause the munition controller to:

receive, via the munition control circuitry, instructions to deflagrate the explosive ordnance;

instruct, via the munition control circuitry, the deflagration module to activate the deflagration initiator; and cause, via the deflagration initiator, a deflagration of the explosive ordnance.

17. The system of claim 16, wherein the command and control unit is positioned away from the plurality of munitions a distance substantially in a range between 10 kilometers to 200 kilometers.

18. The system of claim 16, wherein the set of instructions are executable by the processor to further cause the munition controller to:

determine, via an electronic safe and arm device (ESAD), that a set of arming criteria for deflagration is satisfied;

wherein instructing the deflagration module to activate the deflagration initiator is in response to determining that the set of arming criteria for deflagration is satisfied.

19. The system of claim of claim 18, wherein the set of arming criteria includes one or more of: the physical orientation of the munition, the acceleration of the munition, authorization credentials, target distance from the munition, sensor data confidence, and probability of successful engagement with a target.

20. The system of claim 16, wherein deflagration of the explosive ordnance is a substantially non-pressurized in the munition such that pressure resulting from the deflagration escapes the housing via the one or more openings at a rate that is equal to or greater than a rate of pressure build-up within the housing.

* * * * *